US007631725B2

(12) United States Patent
Towne et al.

(10) Patent No.: US 7,631,725 B2
(45) Date of Patent: Dec. 15, 2009

(54) EXHAUST SYSTEM

(75) Inventors: Lloyd I. Towne, Bryan, OH (US); Thomas R. Headley, Bryan, OH (US)

(73) Assignee: Ingersoll Rand Company, Montvale, NJ (US)

( * ) Notice: Subject to any disclaimer, the term of this patent is extended or adjusted under 35 U.S.C. 154(b) by 460 days.

(21) Appl. No.: 11/539,241

(22) Filed: Oct. 6, 2006

(65) Prior Publication Data

US 2008/0083582 A1 Apr. 10, 2008

(51) Int. Cl.
*F01N 1/08* (2006.01)
*F01N 1/00* (2006.01)
*F01N 1/02* (2006.01)

(52) U.S. Cl. ..... 181/230; 181/243; 181/250; 181/269; 181/281

(58) Field of Classification Search ..... 181/230, 181/229, 233, 243, 250, 249, 255, 269, 270, 181/272, 273, 276, 281, 224, 225
See application file for complete search history.

(56) References Cited

U.S. PATENT DOCUMENTS

| | | | | | |
|---|---|---|---|---|---|
| 213,348 | A | * | 3/1879 | Richardson | 181/281 |
| 624,062 | A | | 5/1899 | Mattews et al. | |
| 728,105 | A | * | 5/1903 | Hipple et al. | 181/281 |
| 1,084,883 | A | | 1/1914 | Holzwarth | |
| 1,377,199 | A | * | 5/1921 | Granby | 137/542 |
| 1,402,896 | A | * | 1/1922 | Schneebeli | 181/272 |
| 1,483,929 | A | * | 2/1924 | Coleman | 209/199 |
| 1,547,601 | A | | 7/1925 | Maxim | |
| 1,698,842 | A | | 1/1929 | Etep | |
| 1,772,589 | A | | 8/1930 | Beamer | |
| 1,796,441 | A | * | 3/1931 | Compo | 181/273 |
| 2,485,555 | A | | 10/1949 | Bester | |
| 3,029,895 | A | | 4/1962 | Lyon | |
| 3,341,115 | A | | 9/1967 | Beck et al. | |
| 3,374,858 | A | * | 3/1968 | Richards | 181/274 |
| 3,719,251 | A | | 3/1973 | Hedrick | |
| 3,779,340 | A | * | 12/1973 | Hoffman et al. | 181/271 |
| 4,055,231 | A | * | 10/1977 | Martinez | 181/241 |
| 4,212,370 | A | * | 7/1980 | Dreher et al. | 181/230 |
| 4,236,598 | A | * | 12/1980 | Wirt | 181/231 |
| 4,367,807 | A | * | 1/1983 | Fink et al. | 181/230 |
| 4,685,534 | A | * | 8/1987 | Burstein et al. | 181/251 |
| 4,925,368 | A | | 5/1990 | Toth | |
| 5,109,950 | A | * | 5/1992 | Lescher | 181/256 |
| 5,290,974 | A | * | 3/1994 | Douglas et al. | 181/228 |
| 5,413,189 | A | * | 5/1995 | Browning et al. | 181/268 |
| 5,559,310 | A | | 9/1996 | Hoover et al. | |
| 6,024,189 | A | * | 2/2000 | Heuser | 181/264 |

(Continued)

*Primary Examiner*—Edgardo San Martin
(74) *Attorney, Agent, or Firm*—Michael Best & Friedrich LLP

(57) ABSTRACT

An exhaust system comprising: an exhaust chamber having a longitudinal axis and an outer wall defining alternating longitudinally-extending ribs and grooves; and an insert within the exhaust chamber, the insert including a plurality of fins extending generally perpendicular to the longitudinal axis, each fin including a distal edge extending substantially close to the plurality of ribs, the insert defining expansion chambers between adjacent fins. Pressurized gas flowing through the exhaust chamber flows along the grooves and expands within the expansion chambers to reduce the pressure of the pressurized gas prior to the gas exiting the exhaust chamber. The fins may in some embodiments be sufficiently stiff to resist substantial deflection under the influence of the gas.

19 Claims, 5 Drawing Sheets

U.S. PATENT DOCUMENTS

| | | | | |
|---|---|---|---|---|
| 6,089,347 | A | 7/2000 | Flugger | |
| 6,209,678 | B1 * | 4/2001 | Sterling | 181/230 |
| 6,488,482 | B1 * | 12/2002 | Yannascoli et al. | 417/312 |
| 6,622,819 | B2 | 9/2003 | Reynolds | |
| 6,926,117 | B2 | 8/2005 | Sterling | |
| 6,957,952 | B1 | 10/2005 | Steck et al. | |
| 7,337,876 | B2 * | 3/2008 | Larsen | 181/225 |
| 2002/0060107 | A1 * | 5/2002 | Kamoshita et al. | 181/214 |
| 2006/0048996 | A1 | 3/2006 | Buckley | |
| 2008/0264719 | A1 * | 10/2008 | Seko et al. | 181/229 |

* cited by examiner

EXHAUST SYSTEM

BACKGROUND

The present invention relates to an exhaust system for a pressurized fluid.

SUMMARY

In one embodiment, the invention provides an exhaust system comprising: an exhaust chamber having a longitudinal axis and an outer wall defining alternating longitudinally-extending ribs and grooves; and an insert within the exhaust chamber, the insert including a plurality of fins extending generally perpendicular to the longitudinal axis, each fin including a distal edge extending substantially close to the plurality of ribs, the insert defining expansion chambers between adjacent fins. Pressurized gas flows through the exhaust chamber along the grooves and expands within the expansion chambers to reduce the pressure of the pressurized gas prior to the gas exiting the exhaust chamber. The fins may in some embodiments be sufficiently stiff to resist substantial deflection under the influence of the gas.

In another embodiment the invention provides an exhaust system comprising: an exhaust chamber adapted to reduce the pressure of a pressurized gas flowing through the exhaust chamber; an exhaust fluid inlet adapted to admit the pressurized gas into the exhaust chamber; an exhaust fluid outlet adapted to vent the pressurized gas out of the exhaust chamber; and a resonator stem within the exhaust fluid outlet and adapted to facilitate a change in direction of the pressurized gas as the gas flows through the exhaust fluid outlet.

In another embodiment, the invention provides a method for constructing an exhaust system, the method comprising the steps of: (a) providing an exhaust chamber that defines a longitudinal axis and that includes a wall defining a plurality of alternating ribs and grooves; (b) providing a unitary insert that includes a flange, an outlet, a resonator stem within the outlet and having a longitudinal extent, and a plurality of substantially rigid fins having distal ends and defining expansion chambers between the fins; (c) inserting the unitary insert into the exhaust chamber with the longitudinal extent of the resonator stem being substantially parallel to the longitudinal axis, and with the fins extending substantially perpendicular to the longitudinal axis of the exhaust chamber with the distal ends substantially close to the ribs and grooves of the exhaust chamber wall; and (d) fastening the flange of the insert to the exhaust chamber wall.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
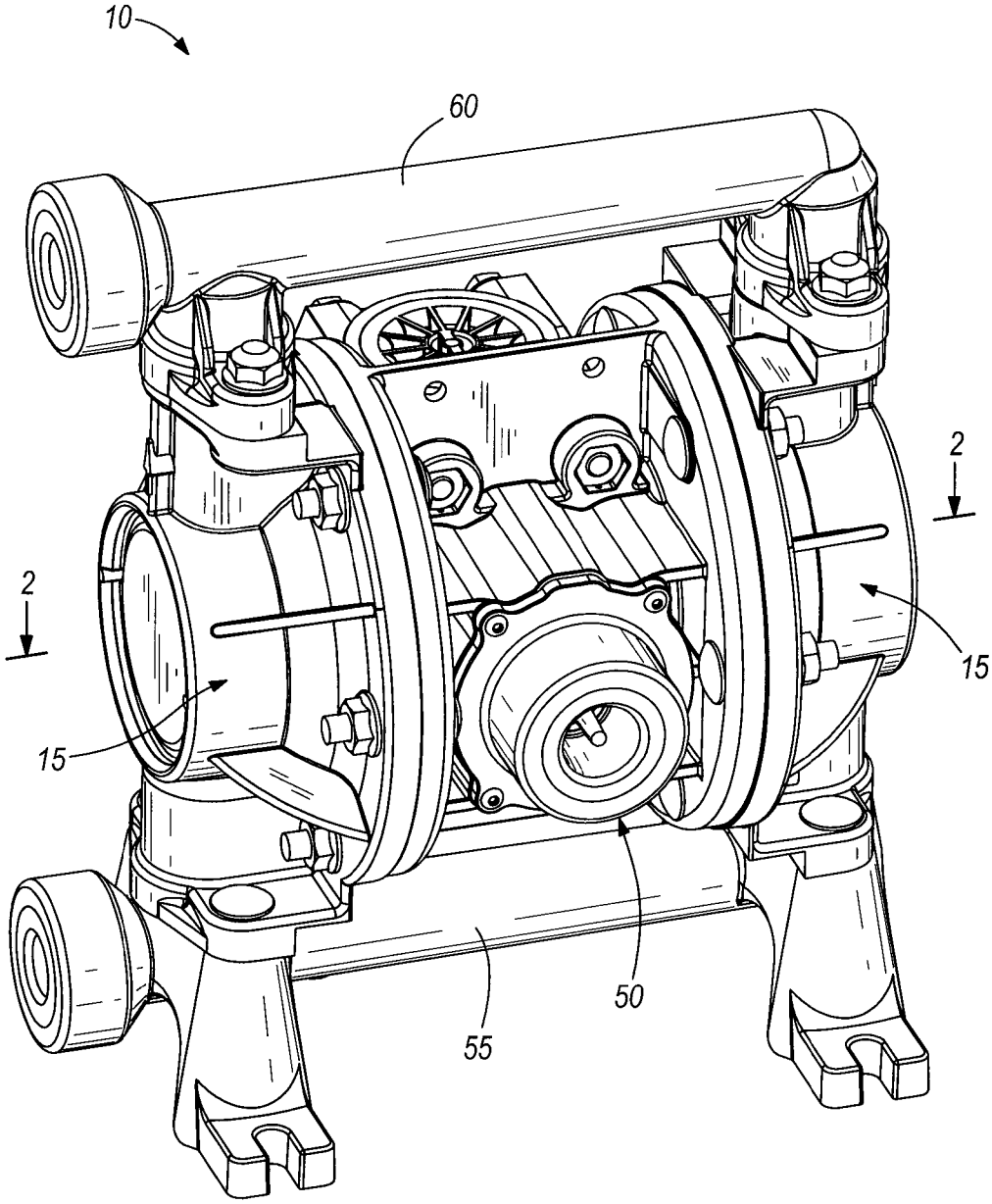
FIG. 1 is a perspective view of a double diaphragm pump embodying the present invention.
Figure 2:
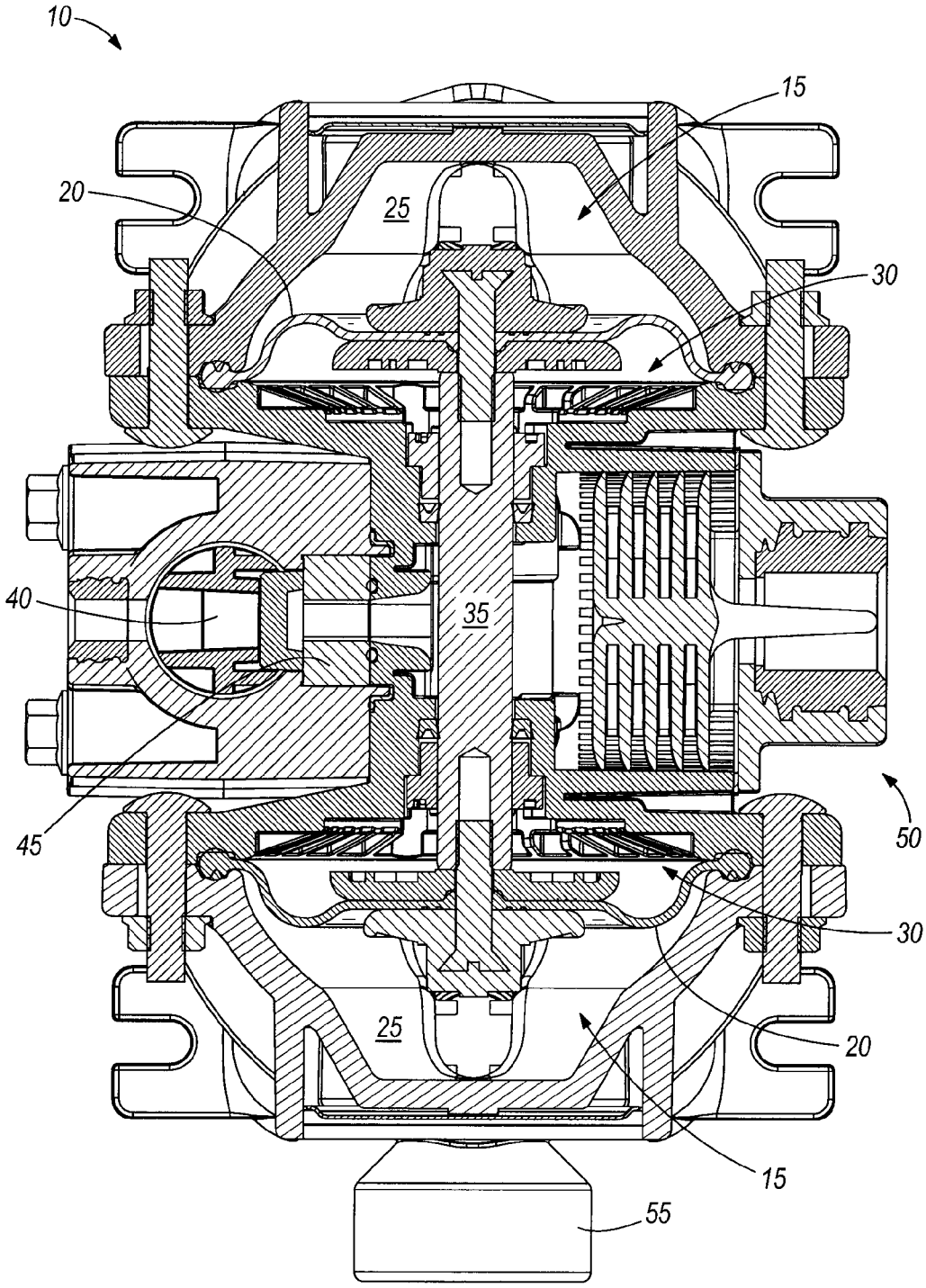
FIG. 2 is a cross-section view of the pump taken along line 2-2 in FIG. 1.

FIGS. 1 and 2 illustrate a double diaphragm pump 10 having a housing defining first and second working chambers 15. The first and second working chambers 15 are divided with respective first and second flexible diaphragms 20 into respective first and second pumping chambers 25 and first and second motive fluid chambers 30. The diaphragms 20 are interconnected through a shaft 35 such that when one diaphragm 20 is moved to increase the volume of the associated pump chamber 25, the other diaphragm is simultaneously moved to decrease the volume of the associated pump chamber 25. The pump 10 includes an inlet 40 for the supply of a motive fluid (e.g., compressed air or another pressurized gas) and a valve 45 for alternatingly supplying the motive fluid to the first and second motive fluid chambers 30 to drive reciprocation of the first and second diaphragms 20 and the shaft 35. Simultaneously with supplying the motive fluid to one of the motive fluid chambers 30, the valve 45 places an exhaust assembly 50 in communication with the other motive fluid chamber 30 to permit motive fluid to be expelled therefrom.

In operation, as the diaphragms 20 and shaft 35 reciprocate, the first and second pump chambers 25 alternatingly expand and contract to create respective low and high pressure within the respective first and second pump chambers 25. The pump chambers 25 communicate with an inlet manifold 55 that is connected to a source fluid to be pumped, and also communicate with an outlet manifold 60 that is connected to a receptacle for the fluid being pumped. Check valves ensure that the fluid being pumped moves only from the inlet manifold 55 toward the outlet manifold 60. When one of the pump chambers 25 expands, the resulting negative pressure draws fluid from the inlet manifold 55 into the pump chamber 25. Simultaneously, the other pump chamber 25 contracts, which creates positive pressure to force the fluid into the outlet manifold 60.

Figure 3:
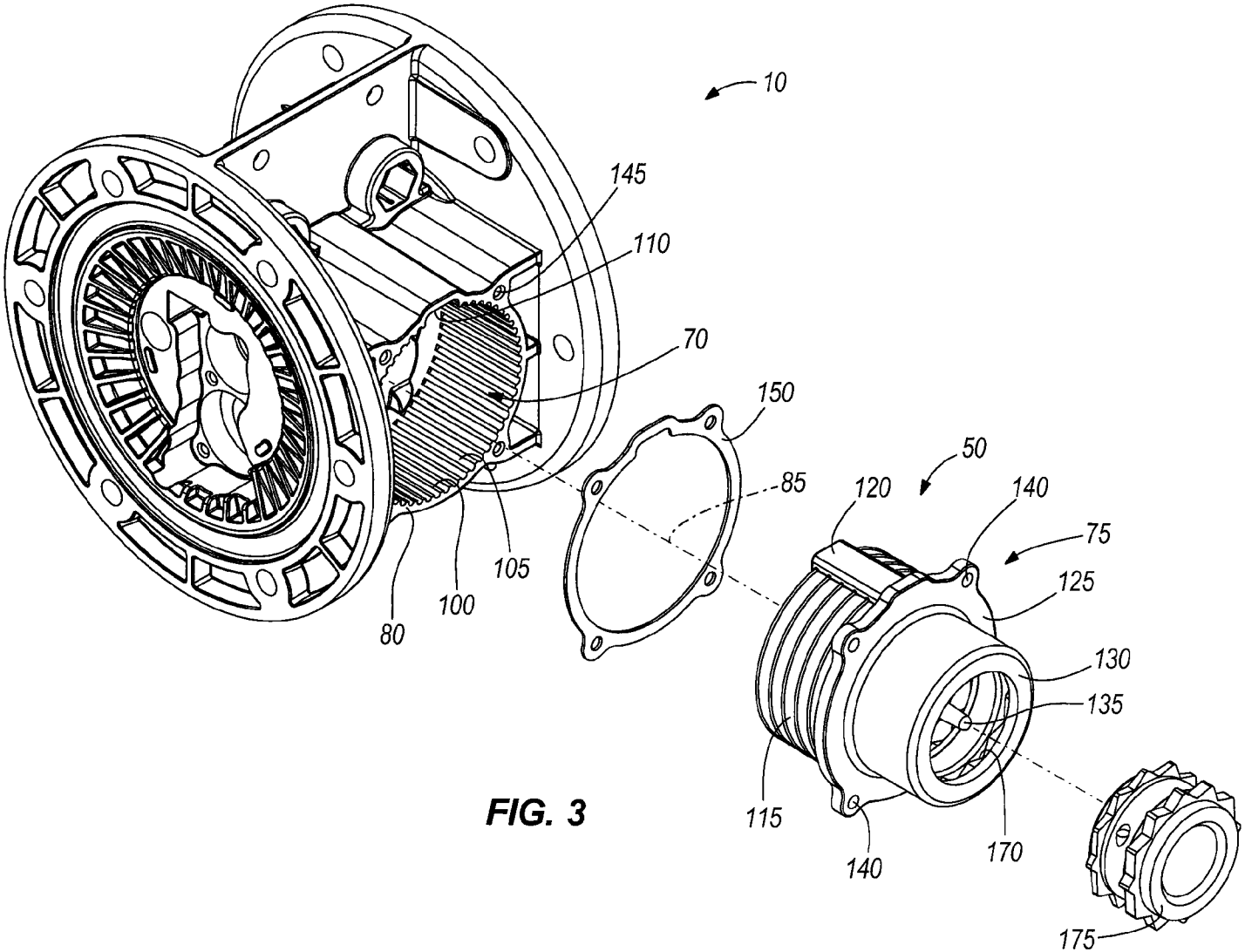
FIG. 3 is an exploded view of an exhaust assembly for the pump.
Figure 5:
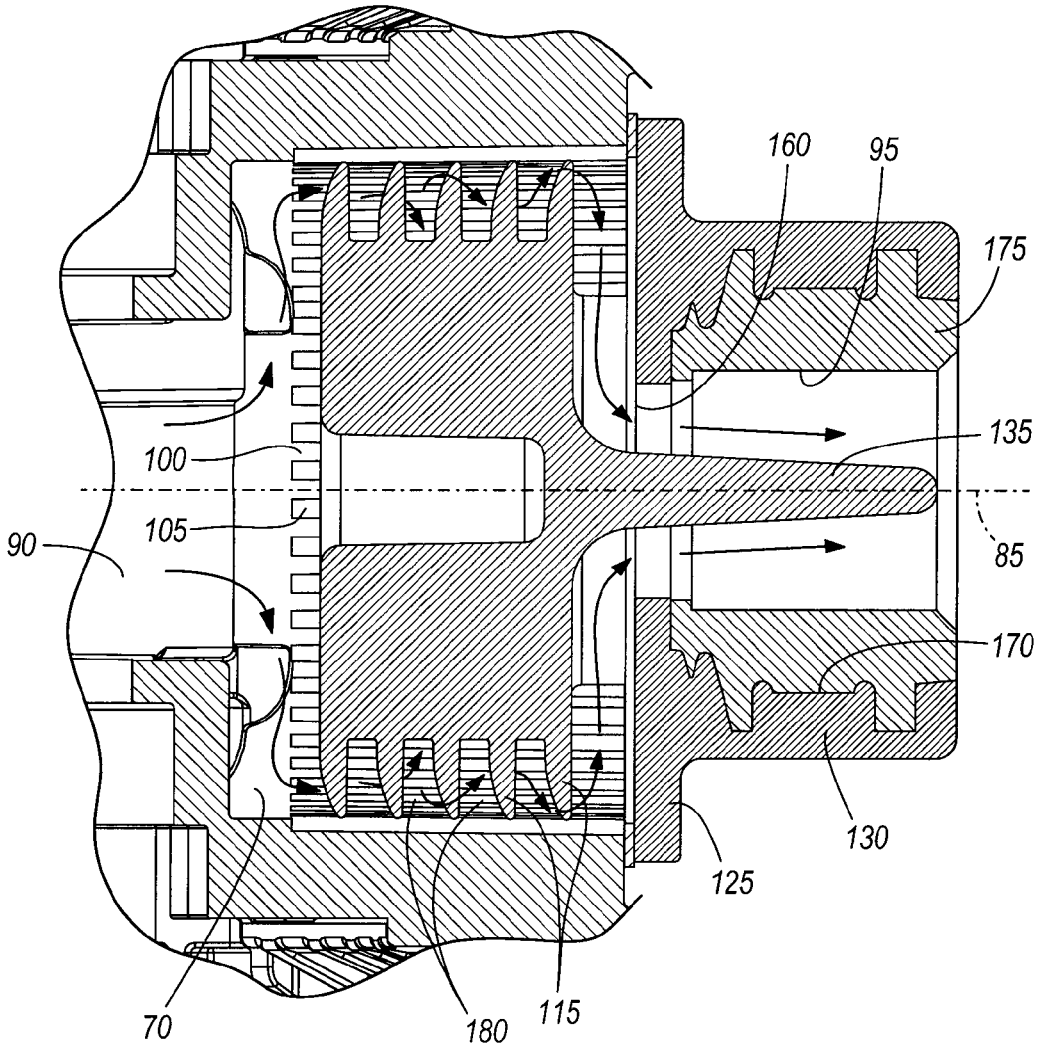
FIG. 5 is a cross-section view of the exhaust assembly.

With reference to FIG. 3, the exhaust assembly 50 includes an exhaust chamber 70 and an insert 75. The exhaust chamber 70 includes an outer wall 80, which in the illustrated embodiment is cylindrical and defines a longitudinal axis 85 running down the center of the chamber 70 from an exhaust fluid inlet 90 to an exhaust fluid outlet 95 (FIG. 5). The exhaust chamber 70 may be integrally cast with a portion of the pump housing in some embodiments, or may be separately fabricated and mounted to the pump housing. It may also exist in various other geometries, and the illustrated cylindrical geometry should not be regarded as limiting. The inner surface of the wall 80 includes alternating longitudinal (i.e., extending generally parallel to the longitudinal axis 85) ribs 100 and grooves 105, and also includes a longitudinal key slot 110. Although the ribs and grooves 100, 105 of the illustrated embodiment are integrally formed into the chamber wall 80, they may be provided on a separate template and mounted to an inner surface of the chamber wall 80 in other embodiments.

Figure 4:
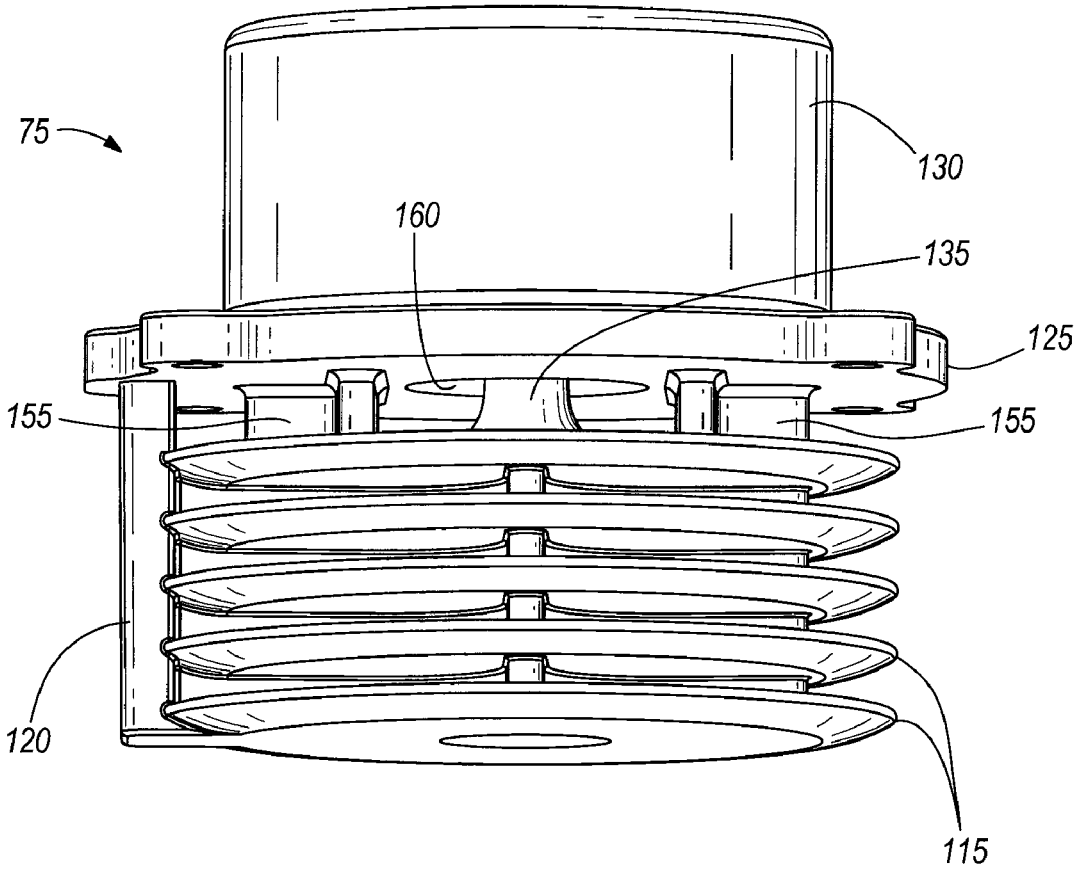
FIG. 4 is a perspective view of an insert of the exhaust assembly.

With reference to FIGS. 3 and 4, the insert 75 includes a plurality of perpendicular (i.e., substantially perpendicular to the longitudinal axis 85 of the exhaust chamber 70 when assembled) fins 115, a longitudinal key 120 extending across the distal ends of the fins 115, a flange 125, a collar 130, and a resonator stem 135. The illustrated insert 75 is integrally formed as one part by a process such as casting, and is constructed of a substantially rigid material such as aluminum, steel, cast iron, or rigid plastic. The illustrated fins 115 are rigid (i.e., do not deflect under the influence of the motive fluid), but in other embodiments the fins 115 maybe compliant and deflectable. In other embodiments, the fins 115 may be sized to contact the ribs 100 in the exhaust chamber wall 80. In such embodiments, the fins 115 may have some flexibility, such that they deflect during insertion, but are substantially rigid once inserted.

The flange 125 includes a plurality of fastener holes 140. When the key 120 of the insert 75 is received within the key slot 110 of the exhaust chamber wall 80, the fastener holes 140 of the flange 125 align with fastener holes 145 in the wall 80 of the exhaust chamber 70 to facilitate mounting the insert 75 to the exhaust chamber 70. In the illustrated embodiment, a gasket 150 is interposed between the flange 125 and the edge of the exhaust chamber wall 80 to create a substantially airtight seal therebetween. The flange 125 is spaced from the last fin 115 with spacers 155 and the key 120, and the flange 125 includes a central hole 160.

The collar 130 surrounds the central hole 160 in the flange 125. The illustrated collar 130 is generally cylindrical and defines a collar longitudinal axis which is generally collinear with the exhaust chamber longitudinal axis 85 when the exhaust assembly 50 is assembled. Together, the central hole 160 and collar 130 define the exhaust fluid outlet 95 through which motive fluid escapes from the exhaust chamber 70. The illustrated collar 130 includes recesses 170 for receiving a coupler 175 (FIG. 2) to facilitate connecting a conduit to the exhaust fluid outlet 95 so that the flow of exhausted motive fluid can be steered in a desired direction.

The resonator stem 135 extends from the last fin 115 through the central hole 160 of the flange 125 and into the space within the collar 130. The longitudinal extent of the resonator stem 135 is substantially collinear with the collar longitudinal axis, and thus with the longitudinal axis 85 of the exhaust chamber 70 when the exhaust assembly 50 is assembled.

Turning now to FIG. 5, the distal ends of the fins 115 are in close proximity with the ribs 100, and expansion chambers 180 are defined between the fins 115. As used herein, the terms "in close proximity" and "substantially close" are used in reference to the spacing between the fins 115 and ribs 100 means that the distal ends of the fins 115 are sufficiently close to the ribs 100 (whether in contact with the ribs or not) to create back pressure that causes the motive fluid to expand into the expansion chambers 180. In other words, the distal ends of the fins 115 must be close enough to the ribs 100 to prevent the motive fluid from blowing past the insert 75 without expanding into the expansion chambers 180.

As high pressure motive fluid flows into the exhaust chamber 70 through the exhaust fluid inlet 90, it flows around the outside of the insert 75, as indicated with the arrows in FIG. 5. More specifically, the motive fluid flows through the grooves 105 along the wall 80 of the exhaust chamber 70 and expands into the expansion chambers 180 between the fins 115. As the motive fluid moves from expansion chamber to expansion chamber on its way through the exhaust chamber 70, it incrementally cools and loses pressure. In this regard, the expansion chambers 180 may be termed "cascading expansion chambers" because the motive fluid "spills" from one to the next.

Once the motive fluid flows around the last fin 115, it is flowing in a direction generally perpendicular to the longitudinal axis 85 of the exhaust chamber 70. As indicated with the arrows in FIG. 5, the resonator stem 135 facilitates a smooth change in direction of the motive fluid from flowing generally toward the longitudinal axis 85 of the exhaust chamber 70 to flowing generally parallel to the longitudinal axis 85 (i.e., a 90° turn in the illustrated embodiment). The resonator stem 135 thus reduces noise by transitioning the movement of exhaust fluid into a substantially laminar flow prior to exiting the exhaust fluid outlet 95.

Various features and advantages of the invention are set forth in the following claims.

What is claimed is:

1. An exhaust system comprising:

an exhaust chamber having a longitudinal axis and an outer wall defining alternating longitudinally-extending ribs and grooves; and an insert within the exhaust chamber, the insert including a plurality of fins extending generally perpendicular to the longitudinal axis, each fin including a distal edge extending substantially close to the plurality of ribs, the insert defining expansion chambers between adjacent fins;

wherein pressurized gas flowing through the exhaust chamber flows along the grooves and expands within the expansion chambers to reduce the pressure of the pressurized gas prior to the gas exiting the exhaust chamber.

2. The system of claim 1, wherein the insert is integrally formed as a single part.

3. The system of claim 1, wherein the insert includes a flange for rigidly mounting the insert to the exhaust chamber outer wall.

4. The system of claim 1, further comprising an exhaust fluid inlet for the delivery of pressurized gas to the exhaust chamber, and an exhaust fluid outlet defined by the insert through which the gas exits the exhaust chamber.

5. The system of claim 4, wherein the insert includes a resonator stem extending into the exhaust fluid outlet, the resonator stem adapted to facilitate a change in direction of the flow of gas as the gas flows through the exhaust fluid outlet.

6. The system of claim 5, wherein the resonator stem includes a longitudinal extent that is substantially parallel to the longitudinal axis of the exhaust chamber.

7. The system of claim 6, wherein the longitudinal extent of the resonator stem is substantially collinear with the longitudinal axis of the exhaust chamber.

8. The system of claim 6, wherein the resonator stem is adapted to facilitate a change in direction of the pressurized gas from flowing generally perpendicular to the longitudinal axis, to flowing generally parallel to the longitudinal axis.

9. The system of claim 1, wherein the fins are sufficiently stiff to not substantially deflect under the influence of the gas.

10. An exhaust system comprising:

an exhaust chamber adapted to reduce the pressure of a pressurized gas flowing through the exhaust chamber; the exhaust chamber including a longitudinal axis and defining at least one rib and one groove extending substantially parallel to the longitudinal axis;

an exhaust fluid inlet adapted to admit the pressurized gas into the exhaust chamber;

an exhaust fluid outlet adapted to vent the pressurized gas out of the exhaust chamber; and a resonator stem within the exhaust fluid outlet and adapted to facilitate a change in direction of the pressurized gas as the gas flows through the exhaust fluid outlet.

11. The system of claim 10, wherein the resonator stem includes a longitudinal extent that is substantially parallel to said longitudinal axis.

12. The system of claim 11, wherein the longitudinal extent of the resonator stem is substantially collinear with the longitudinal axis of the exhaust chamber.

13. The system of claim 11, wherein the resonator stem is adapted to facilitate a change in direction of the pressurized gas from flowing generally perpendicular to the longitudinal axis, to flowing generally parallel to the longitudinal axis.

14. The system of claim 10, further comprising an insert within the exhaust chamber, the resonator stem extending from the unitary insert; and a plurality of expansion chambers defined by the insert.

15. The system of claim 14, wherein the insert is a unitary object formed via a single step method such as casting or molding.

16. The system of claim 14, wherein the insert includes a plurality of fins extending generally perpendicular to the longitudinal axis, and wherein the expansion chambers are defined between the fins.

17. The system of claim 16, wherein the exhaust chamber includes a wall defining a plurality of alternating ribs and grooves; wherein each fin includes a distal edge extending substantially close to the plurality of ribs and grooves; and wherein pressurized gas flowing through the exhaust chamber flows along the grooves and expands within the expansion chambers to reduce the pressure of the pressurized gas prior to the gas exiting the exhaust chamber.

18. The system of claim 16, wherein the fins are sufficiently stiff to not substantially deflect under the influence of the gas.

19. A method for constructing an exhaust system, the method comprising the steps of:

(a) providing an exhaust chamber that defines a longitudinal axis and that includes a wall defining a plurality of alternating ribs and grooves extending substantially parallel to the longitudinal axis;

(b) providing a unitary insert that includes a flange, an outlet, a resonator stem within the outlet and having a longitudinal extent, and a plurality of substantially rigid fins having distal ends and defining expansion chambers between the fins;

(c) inserting the unitary insert into the exhaust chamber with the longitudinal extent of the resonator stem being substantially parallel to the longitudinal axis, and with the fins extending substantially perpendicular to the longitudinal axis of the exhaust chamber with the distal ends proximate the ribs and grooves of the exhaust chamber wall; and (d) fastening the flange of the insert to the exhaust chamber wall.

* * * * *

UNITED STATES PATENT AND TRADEMARK OFFICE

CERTIFICATE OF CORRECTION

PATENT NO. : 7,631,725 B2
APPLICATION NO. : 11/539241
DATED : December 15, 2009
INVENTOR(S) : Towne et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 530 days.

Signed and Sealed this

Second Day of November, 2010

David J. Kappos

David J. Kappos
*Director of the United States Patent and Trademark Office*